United States Patent [19]

Ohashi

[11] Patent Number: 4,797,517

[45] Date of Patent: Jan. 10, 1989

[54] SWITCH DEVICE OF PORTABLE FLASHLIGHT

[75] Inventor: Keiichi Ohashi, Shizuoka, Japan

[73] Assignee: Skylite Industry Co., Ltd., Shizuoka, Japan

[21] Appl. No.: 98,149

[22] Filed: Sep. 18, 1987

[51] Int. Cl.[4] ..... F21V 23/04

[52] U.S. Cl. ..... 200/60; 362/251

[58] Field of Search ..... 200/11 R, 11 EA, 11 K, 200/60; 362/155, 184, 205, 212, 251, 394

[56] References Cited

U.S. PATENT DOCUMENTS

| | | | |
|---|---|---|---|
| 2,118,656 | 5/1938 | Putt | 200/60 X |
| 2,303,086 | 11/1942 | Muldoon | 200/60 X |
| 3,944,761 | 3/1976 | Nicholl et al. | 200/60 X |
| 4,286,311 | 8/1981 | Maglica | 362/205 |
| 4,536,829 | 8/1985 | Grimm et al. | 362/251 X |

*Primary Examiner*—J. R. Scott

*Attorney, Agent, or Firm*—Wegner & Bretschneider

[57] ABSTRACT

A switch device of the portable flashlight includes a casing, two bulbs built in the casing and a lighting circuit connected to the bulbs, and a switch mounted on the casing for turning on and off the lighting circuit. The switch device comprises members for operational part of a switch and having a turnable; contact members installed on the axis of the turnable; base-board for supporting the turnable; two contact members installed on the base-board for detachably engaging the first contact member; and recess formed with the casing to receive the base-board and having a hole through which the lighting circuit is connected with the above three contact member.

4 Claims, 3 Drawing Sheets

SWITCH DEVICE OF PORTABLE FLASHLIGHT

BACKGROUND OF THE INVENTION

1. Field of the Invention

The present invention relates to a switch device of a portable flashlight and more particularly relates to an improvement of the operation and durability in a switch device of the portable flashlight containing two bulbs which can be turned on and off.

2. Statement of the Prior Art

The conventional portable flashlight comprises, for example, as shown in FIG. 5, an outer casing C which is made of plastic, etc., two bulbs LA, LB, a dry battery B, a switch S and a lighting circuit W. The casing C is provided with the switch S which turns on and off and opens and closes the lighting circuit W. The lighting of the bulbs LA and LB can be turned on and off by the thumb of an operator while he holds the casing C.

Such well known switch of the portable flashlight can be slide along the casing C so that the height of the projection portion of the switch "S" becomes small, since it is difficult to operate the switch by the thumb of the operator while he holds the casing C if the height H of the projection portion becomes large.

The above mentioned conventional switch device has the function which turns on and off the two bulbs LA and LB, and therefore, it includes a number of parts and is somewhat complicated in construction. This slide-type arrangement has a weak point of durability, such that the bulbs LA and LB cannot be turned on an doff smoothly and reliably since sliding friction between the individual parts becomes strong and the individual parts becomes abrasive.

Furthermore, the slide-type arrangement has a disadvantage in operation, such that it is difficult to slide the switch due to sands the like attached onto the surface of the casing C since it requires a large space for sliding on the surface of the casing C.

SUMMARY OF THE INVENTION

An object of this invention is to provide a switch device as mentioned above having good durability and operation in order to overcome these drawbacks.

The switch device of the portable flashlight according to the present invention is installed on outer casing of the flashlight with two built-in bulbs which can be freely turned on and off as the switch opens or closes the lighting circuit kept in the casing.

The switch device comprises means for operational part of a switch and having a turntable; contact members installed on the axis of the turntable; base-board for supporting the turntable; two contact members installed on the base-board for detachably engaging the first contact member; recess formed on the casing to receive the base-board and having hole through which the lighting circuit is connected with the above three contact member.

The switch device of the portable flashlight in accordance with the present invention improves operation since the device demonstrates a marked resistance to damaging of the surface of the casing by having rotating system of the operational part of the switch, and improves durability since the rotating system is made simple in construction by providing a reduce number of parts and prevents abrasion between the individual parts.

Many other advantages, features and additional objects of the present invention will become apparent to those skilled in the art upon making reference to the detailed description and accompanying sheets of the drawings on which preferred structural embodiments incorporating the principles of the present invention are shown only by way of illustration.

DETAILED DESCRIPTION OF THE PREFERRED EMBODIMENTS

Hereinafter, the embodiments of the switch device of the portable flashlight in accordance with the present invention are described on the basis of the FIG. 1 to FIG. 4.

Figure 1:
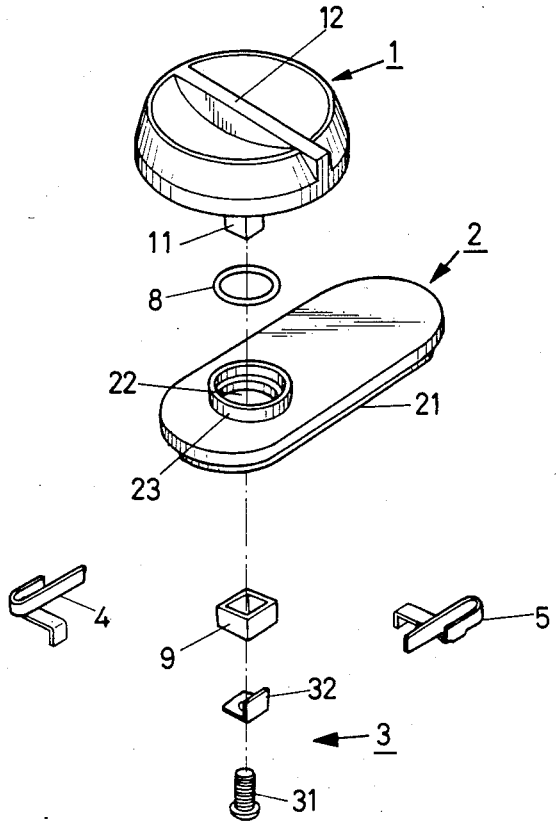
FIG. 1 is a disassembled perspective view of an embodiments of the switch device of the portable flashlight in accordance with the present invention.
Figure 2:
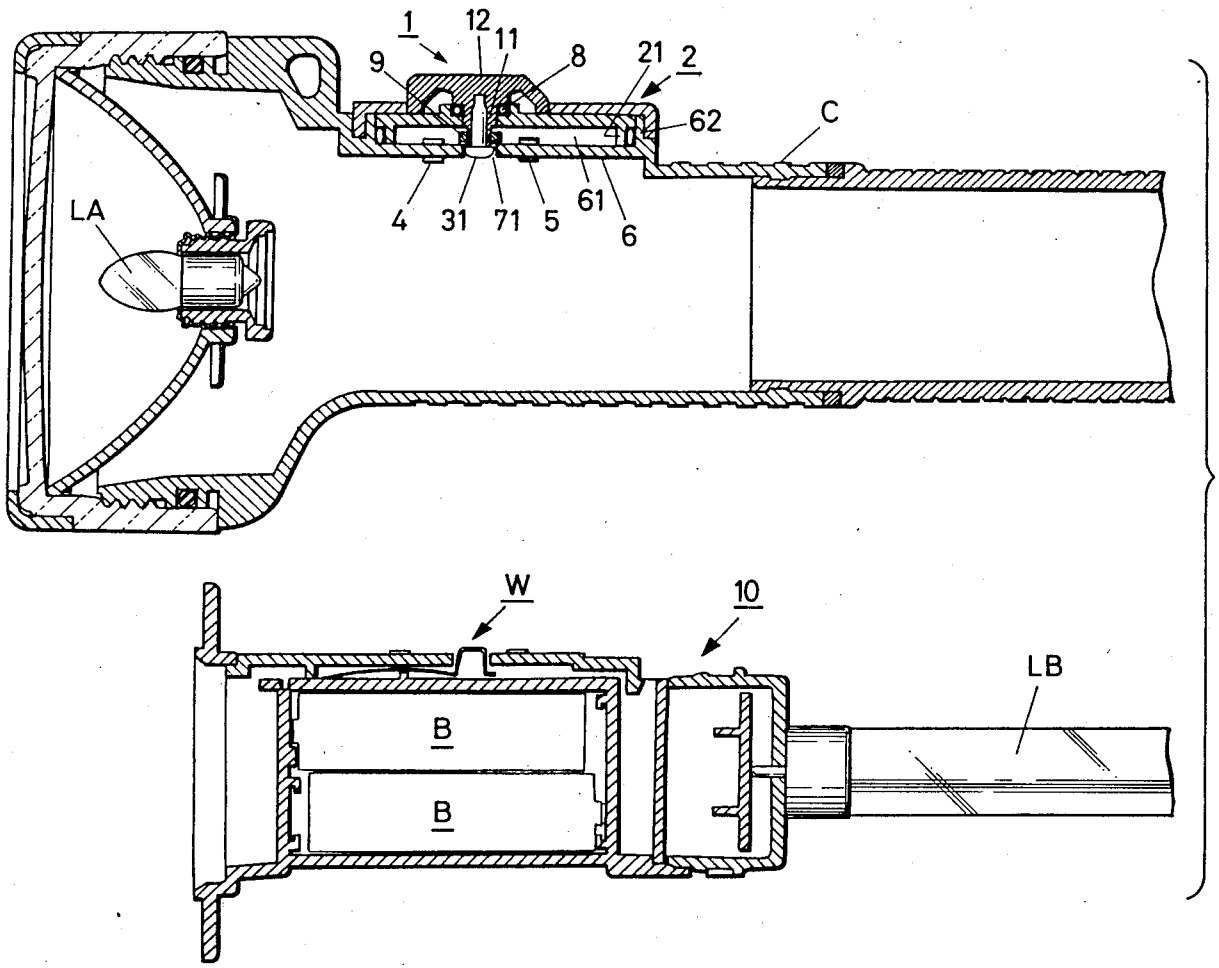
FIG. 2 is a sectional view showing the assembled switch device of the respective elements of FIG. 1.
Figure 3:
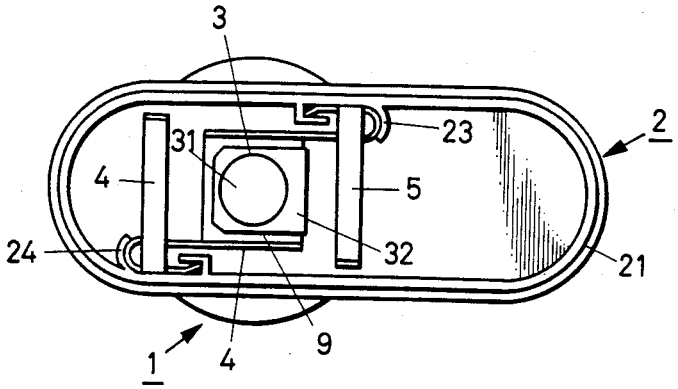
FIG. 3 is an enlarged bottom view showing the assembled switch device of the respective elements of FIG. 1.

FIG. 1 shows the disassembled individual parts of the elements of the embodiments of the switch device of the portable flashlight in accordance with the present invention and FIG. 2 shows the portable flashlight to which are assembled these individual parts. Namely, the individual parts are an operational part 1, a base-board 2 and contact members 3, 4, 5. Further, a recess 6 and a connecting hole 7 are formed on the casing C.

The operational part 1 is made of plastic material etc. and formed into a pointed top shape. The operational part 1 has an axis 11 at the bottom thereof and a rib-shaped handle 12 at the head thereof for operation and indicaton of switching position.

The base-board 2 is made of plastic material etc. and formed in a plate shape and has an engaging portion 21 at the bottom thereof. An insert hole 22 for insertion of the axis 11 of the operational part 1 and a collar 23 around the insert hole for supporting the operational part 1 are formed on the base-board. Further, as shown in the FIG. 3, grooves 23 and 24 for mounting the two contact members 4 and 5 are provided symmetrically with respect to the insert hole 22 on the back side of the base-board 2.

The contact members 3, 4, 5 are made by bending conductive metal materials. The contact members 3 to be attached to the axis 11 of the operational part 1 comprises a screw 31 and an L-shaped piece 32 having a hole in which the screw 32 is inserted. The contact members 4 and 5 attached to the base-board 2 have a U-shaped portion and an L-shaped portion. One leg of the U-shaped portion is longer than the other leg of the U-shaped portion, and the L-shaped portions extend at a right angle therefrom.

The recess 6 is integrally formed with the casing C and contains a cavity 61 made at a lower level in the casing C. The top edge thereof comprises a stepped part 62 which fits in the engaging portion 21 of the base-board 2.

Figure 4:
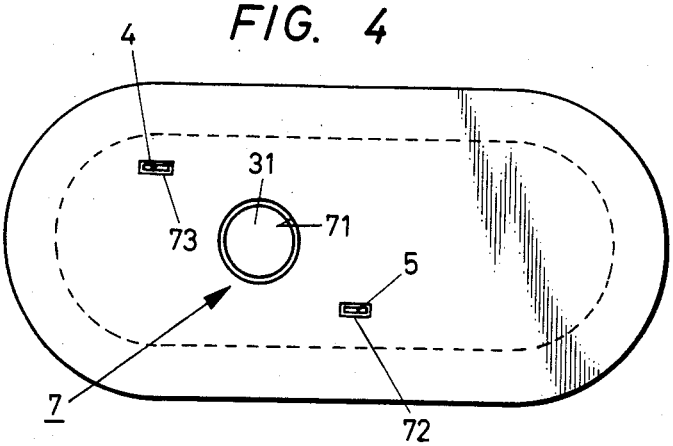
FIG. 4 is an enlarged bottom view of FIG. 2.

The connecting hole 7 connects the contact members 3, 4, 5 with the contact points of the lighting circuit W disposed outside the recess 6 in the casing C. As shown in FIG. 4, three connecting holes 71, 72, 73 are formed in the casing C correspondingly to the respective ends of the contact members 3, 4, 5.

When the contact members 3, 4, 5 are slightly exposed respectively over the connection holes 71, 72, 73 dry batteries B and the lighting circuit W formed in a cartridge make the structure compact and connection is made easy. FIG. 2 shows an example of a portable flashlight structure in this way. The ends of the contact members 4 and 5 pass through the connection holes 73, 72 to come out under the recess 6. The bulbs LA, LB, dry batteries B and lighting circuit W are put in the cartridge 10 and the respective contact points of the lighting circuit W are formed on the points corresponding to the connecting holes 71, 72, 73. When this cartridge 10 is put in the casing C, the respective contact points of the switch connect with the respective contact points of the lighting circuit W.

Regarding the way of assembly of the above mentioned individual parts, the axis 11 of the operational part 1 is inserted in the insert hole 22 of the base-board 2 and an O-ring 8 is fitted around the collar 23 of the base-board 2 to make it waterproof, and then the operational part 1 is supported on the collar 23. Thereafter, a fixing piece 9 is fitted on the axis 11 and the L-shaped piece 32 of the contact member 3 is fitted and secured by a screw 31. Further, the contact members 4, 5 are attached to the grooves 23 and 24 of the base-board 2. When the respective parts are assembled as above, the height H of the projected portion is made low and flat. As shown in details in FIG. 3, the above mentioned fixing piece 9 is placed between both sides by elasticity of the contact members 4, 5 attached to the grooves 23, 24 of the base-board 2.

Figure 5:
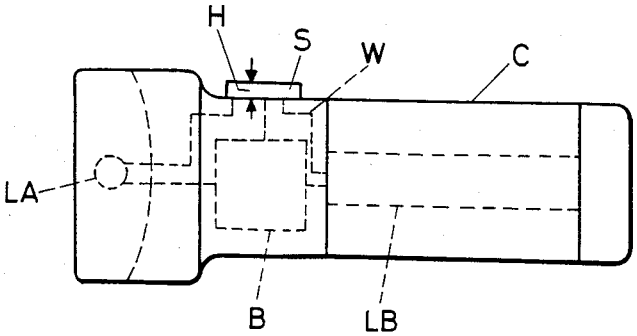
FIG. 5 is a side view showing the general structure of the portable flashlight.

In this embodiment, the contact members 3 attached to the axis 11 of the operational part 1 and the contact members 4, 5 attached to the grooves 23, 24 of the base-board 2 contact with and separate from each other, by rotating the operational part 1 in the narrow space around the axis 11 on the surface of the casing C and the lighting circuit W turns on and off. As shown in details in the FIG. 5, the both bulbs LA, LB turn off when the lighting circuit W opens. When the operational part 1 rotates counter clockwise against the elasticity of the contact members 4, 5, the contact members 3 (L-shaped piece 32) contacts the contact member 4 without causing the friction to the other parts and then only the front bulb LA turns on. When the operational part 1 rotates clockwise further against the elasticity of the contact members 4, 5, the contact member 3 (L-shaped piece 32) contacts the contact member 5 without causing the friction to the other parts and then the front bulb LA turns off and only the rear bulb LB turns on. The contact members 4, 5 which place the fixing piece 9 between the both sides offers an advantage that it prevents the operational part 1 from unexpectedly turning and the operator can sense the completion of the turning on and off operation by the elasticity of the contact members 4, 5.

As can be seen from the above, this unique switch structure of the portable flashlight according to the present invention can prevent abrasion among individual parts by providing a turntable structure with the switch operational portion. The result is an ensured durability since the operational portion of the switch is made up of a reduced number of parts and, therefore, is simple in construction. In addition, this simple structure has the obvious advantages in making manufacture of the portable flashlight easier and lowering production cost. Furthermore, owing to the turntable switch formed low and flat and removal of sliding part on the casing required by the conventional slide-type switching structure, this portable flashlight offers a marked resistance to possible damages thereof by contamination of sands etc. and a good operation.

What is claimed is:

1. A switch device of a portable flashlight having a casing, built-in casing for housing bulbs, and a lighting circuit connected to said bulbs, and a rotatable switch mounted on said casing for turning on and off said casing for turning on and off said lighting circuit, comprising:

means for operating said rotatable switch;

a turnable contact means coupled to said operating means on said axis of said rotatable switch;

a base-board;

at least two contact means installed on said base-board on opposing sides of said axis and directly on opposing sides of said turnable contact means for selectively detachably engaging said turnable contact means, and wherein said casing has a recess portion to receive said base-board and has a hole through which said lighting circuit is connected with said turnable contact means and said at least two contact means.

2. The switch device of a portable flashlight as in claim 1, wherein said means for operating said switch is rotatable in one direction for lighting at least one of said bulbs and rotatable in an opposite direction for lighting at least one of another of said bulbs.

3. The switch device of a portable flashlight as in claim 1, wherein said at least two contact means extend beyond said base-board for connecting with said lighting circuit.

4. The switch device of a portable flashlight as in claim 1, wherein said two contact means each has a first portion for connecting with said turntable contact means and a second portion, perpendicularly located from said first portion, for connecting with said lighting circuit.

* * * * *